US011988414B2

(12) United States Patent
Branecky et al.

(10) Patent No.: US 11,988,414 B2
(45) Date of Patent: May 21, 2024

(54) SYSTEM AND METHOD FOR CONTROL OF ELECTRIC WATER HEATER

(71) Applicant: A. O. SMITH CORPORATION, Milwaukee, WI (US)

(72) Inventors: Brian T. Branecky, Oconomowoc, WI (US); Ronald Bartos, Menomonee Falls, WI (US)

(73) Assignee: A.O. SMITH CORPORATION, Milwaukee, WI (US)

( * ) Notice: Subject to any disclaimer, the term of this patent is extended or adjusted under 35 U.S.C. 154(b) by 591 days.

(21) Appl. No.: 16/601,141

(22) Filed: Oct. 14, 2019

(65) Prior Publication Data

US 2020/0041168 A1 Feb. 6, 2020

Related U.S. Application Data

(63) Continuation of application No. 15/267,849, filed on Sep. 16, 2016, now Pat. No. 10,443,894.

(51) Int. Cl.

| | |
|---|---|
| ***F24H 9/20*** | (2022.01) |
| ***F24H 1/20*** | (2022.01) |
| ***F24H 15/168*** | (2022.01) |
| ***F24H 15/174*** | (2022.01) |
| ***F24H 15/225*** | (2022.01) |

(Continued)

(52) U.S. Cl.

CPC ..... *F24H 9/2021* (2013.01); *F24H 1/201* (2013.01); *F24H 15/168* (2022.01); *F24H 15/174* (2022.01); *F24H 15/225* (2022.01); *F24H 15/37* (2022.01); *F24H 15/407* (2022.01); *F24H 15/421* (2022.01); *F24H 15/45* (2022.01);

(Continued)

(58) Field of Classification Search

None

See application file for complete search history.

(56) References Cited

U.S. PATENT DOCUMENTS 4,024,378 A * 5/1977 McIntosh ..... G05D 23/275 219/486

4,935,603 A * 6/1990 Iwamoto ..... F24H 15/429 392/454

(Continued)

OTHER PUBLICATIONS

Vajjala, "Demand Response Potential in Aggregated Houses Using Gridlab-D," thesis (2012) pp. 1-55.

(Continued)

*Primary Examiner* — Thor S Campbell

(74) *Attorney, Agent, or Firm* — Michael Best & Friedrich LLP

(57) ABSTRACT

System and methods of operating a water heater receiving power from an electrical grid. The water heater includes a heating element, a controller, and a first control circuit. The first control circuit including an energizing terminal and a microprocessor. The method includes connecting an energizing terminal of the first control circuit between a power output terminal of the controller and the heating element, receiving driving power from the controller based on a temperature signal. The method also includes receiving a control signal from the controller based on electrical grid information, and selectively energizing the heating element, by the microprocessor of the first control circuit and through the energizing terminal of the first control circuit based on the control signal.

16 Claims, 7 Drawing Sheets

(51) Int. Cl.

| | |
|---|---|
| ***F24H 15/37*** | (2022.01) |
| ***F24H 15/407*** | (2022.01) |
| ***F24H 15/421*** | (2022.01) |
| ***F24H 15/45*** | (2022.01) |
| ***F24H 15/493*** | (2022.01) |
| *F24H 15/277* | (2022.01) |
| *F24H 15/281* | (2022.01) |
| *F24H 15/395* | (2022.01) |

(52) U.S. Cl.
CPC ..... *F24H 15/493* (2022.01); *F24H 15/277* (2022.01); *F24H 15/281* (2022.01); *F24H 15/395* (2022.01)

(56) References Cited

U.S. PATENT DOCUMENTS 5,103,078 A * 4/1992 Boykin ..... G05D 23/1904 219/486
5,168,546 A * 12/1992 Laperriere ..... F24H 1/185 219/535
5,293,447 A * 3/1994 Fanney ..... F24H 15/37 219/508
5,539,633 A 7/1996 Hildebrand et al.
5,960,157 A * 9/1999 McGraw ..... G05D 23/1909 392/441
5,968,393 A * 10/1999 Demaline ..... F24H 15/414 219/486
6,242,720 B1 * 6/2001 Wilson ..... H05B 1/0297 219/486
6,271,505 B1 * 8/2001 Henderson ..... F24H 15/225 219/486
6,363,218 B1 * 3/2002 Lowenstein ..... H05B 1/0283 392/498
6,465,764 B1 * 10/2002 Shahin ..... F24H 15/37 219/486
6,808,639 B2 * 10/2004 Rawson ..... F24H 9/0005 210/175
6,861,621 B2 * 3/2005 Ghent ..... F24H 15/45 219/492
7,027,724 B2 * 4/2006 Baxter ..... F24H 15/104 392/441
7,423,243 B2 9/2008 Reusche et al.
7,486,782 B1 2/2009 Roos
7,504,749 B2 3/2009 Von Seidel
7,620,302 B2 * 11/2009 Lesage ..... F24H 1/202 392/455
7,659,493 B2 2/2010 Reusche et al.
8,014,905 B2 9/2011 Ehlers
8,126,320 B2 * 2/2012 Cartwright ..... F24H 15/37 392/441
8,183,995 B2 5/2012 Wang et al.
8,255,090 B2 8/2012 Frader-Thompson et al.
8,897,632 B2 11/2014 Flohr
9,151,516 B2 * 10/2015 Buescher ..... F24H 15/12
9,885,498 B2 * 2/2018 Lesage ..... H05B 1/0283
9,933,184 B2 * 4/2018 Lesage ..... H05B 3/04
10,443,894 B2 * 10/2019 Branecky ..... F24H 15/37
10,724,746 B2 * 7/2020 Lesage ..... F24H 1/181
10,989,421 B2 * 4/2021 Heil ..... F24H 15/486
2004/0042772 A1 3/2004 Whitford et al.
2007/0245980 A1 * 10/2007 Phillips ..... F24H 9/2021 236/20 R
2007/0246552 A1 * 10/2007 Patterson ..... F24H 9/2014 236/21 B
2007/0246556 A1 * 10/2007 Patterson ..... F24H 9/2014 237/8 A
2007/0246557 A1 * 10/2007 Phillips ..... F24H 15/225 237/8 R
2007/0248143 A1 * 10/2007 Phillips ..... G01K 13/00 374/141
2007/0248340 A1 * 10/2007 Phillips ..... F24H 15/174 392/441
2012/0118989 A1 * 5/2012 Buescher ..... F24H 15/37 236/51
2012/0230661 A1 * 9/2012 Alhilo ..... G05B 5/01 392/441
2013/0193221 A1 * 8/2013 Buescher ..... G05D 23/1931 237/8 A
2013/0202277 A1 * 8/2013 Roetker ..... F24H 1/202 392/441
2014/0037275 A1 * 2/2014 Flohr ..... G05F 1/66 392/464
2014/0105584 A1 * 4/2014 Flohr ..... H02J 3/14 392/441
2014/0153913 A1 * 6/2014 Newman ..... F24H 15/174 392/500
2014/0321839 A1 * 10/2014 Armstrong ..... F24H 15/254 392/498
2014/0348493 A1 * 11/2014 Kreutzman ..... F24H 1/0027 392/441
2016/0138830 A1 * 5/2016 Lesage ..... F24H 15/414 219/486
2017/0074544 A1 * 3/2017 Lesage ..... H05B 1/0283

OTHER PUBLICATIONS

Chipango et al., "Domestic Load Control Using PWM and Zero Crossing Detection Techniques," specification (2015) pp. 1-6.

* cited by examiner

SYSTEM AND METHOD FOR CONTROL OF ELECTRIC WATER HEATER

CROSS REFERENCE TO RELATED APPLICATION

This application is a continuation and claims the benefit of U.S. Non-Provisional patent application Ser. No. 15/267,849, filed Sep. 16, 2016, the entire contents of which are herein incorporated by reference.

FIELD OF INVENTION

The present invention relates to water heaters.

SUMMARY

Electric water heaters typically use electrical energy to heat the water located inside a water tank to within a specific temperature range. The electrical energy may come from a power source such as a grid, or power grid, such as but not limited to an energy company power grid or a home power grid including one or more of solar panels, windmills, or other sources. The power grid distributes electrical energy to balance supply and demand at any specific time within a specific area. The demand for electrical energy from the power grid varies with, for example, time of day, season, geographical area, and other factors. The price for the electricity delivered by the power grid varies according to the overall demand on the power grid at a particular time and area. For example, the price of electricity increases during peak hours, and decreases during off-peak hours.

Some water heaters may include control units that demand electrical energy from the power grid during times of lower demand, while other water heaters demand electrical energy based solely on the temperature of the water with respect to the specific temperature range. Furthermore, upgrading water heaters to consume energy only (or mostly) during off-peak hours may require a different control unit and/or system to be installed in the water heater, making it a costly investment for the water heater manufacturer, and ultimately, the end user.

In one embodiment, the invention provides a water heater receiving electrical power from an electrical grid. The water heater includes a heating element, a relay configured to provide power to the heating element, a controller, and a first control circuit. The controller is coupled to a temperature sensor, and receives temperature signals from the temperature sensor and electrical grid information. The controller further sends an activation signal to the relay based on the temperature signals. The controller also outputs control signals to the first control circuit based on the received electrical grid information. The control circuit is coupled between the relay and the heating element, and includes an energizing terminal and a microprocessor. The energizing terminal is coupled to the heating element to provide driving power to the heating element through the relay. The microprocessor is coupled to the energizing terminal and receives the control signals from the controller. The microprocessor selectively energizes the heating element through the energizing terminal based on the control signals.

In another embodiment, the invention provides a method of operating a water heater receiving electrical power from an electrical grid. The water heater includes a heating element, a controller, and a first control circuit. The method includes connecting an energizing terminal of the first control circuit between a power output terminal of the first controller, and the heating element. The method also includes receiving, by the first control circuit, driving power from the controller based on a temperature signal, receiving, by a microprocessor of the first control circuit, control signals from the controller based on electrical grid information. Finally, the method includes selectively energizing the heating element, by the microprocessor and through the energizing terminal of the first control circuit, based on the received control signals.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawing. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
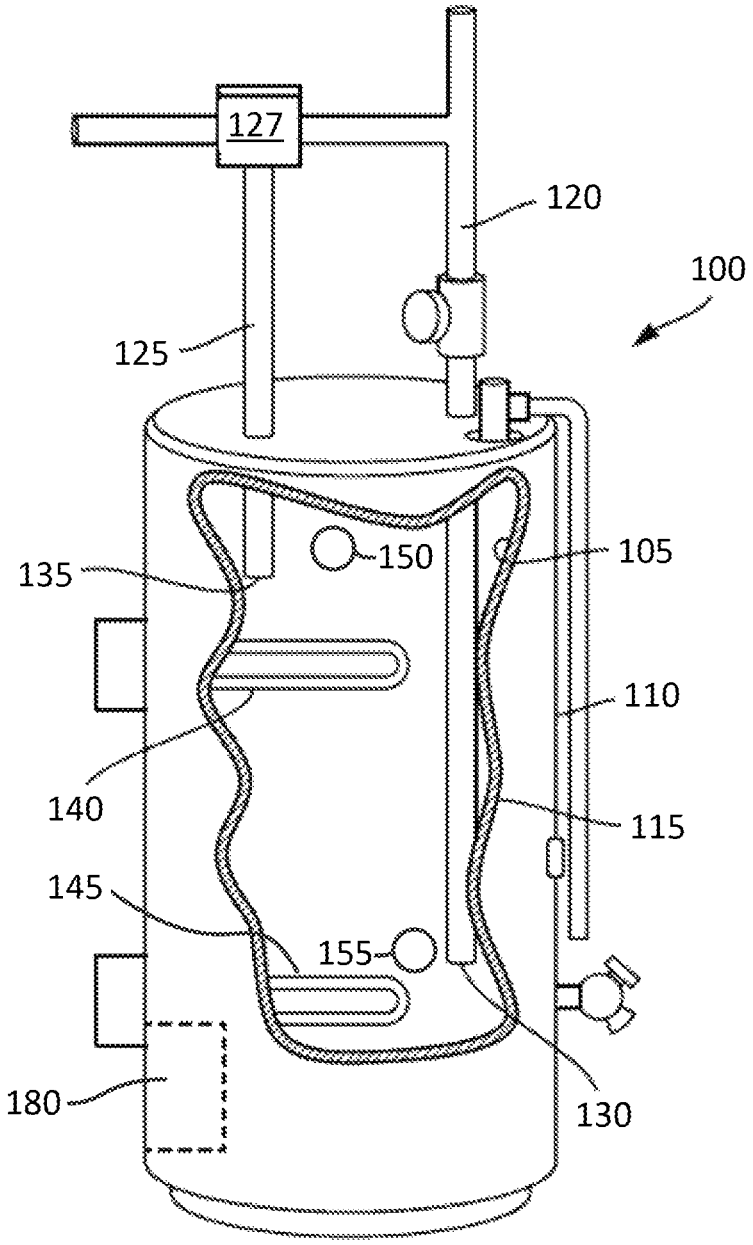
FIG. 1 is a partial exposed view of a water heater according to some embodiments of the invention.

FIG. 1 is a partial exposed view of a storage-type water heater 100 according to some embodiments of the invention. The water heater 100 includes an enclosed water tank 105, a shell 110 surrounding the water tank 105, and foam insulation 115 filling an annular space between the water tank 105 and the shell 110. The water tank 105 may be made of ferrous metal and lined internally with a glass-like porcelain enamel to protect the metal from corrosion. In other embodiments, the water tank 105 may be made of other materials, such as plastic.

A water inlet line 120 and a water outlet line 125 are in fluid communication with the water tank 105 at a top portion of the water heater 100. The inlet line 120 includes an inlet opening 130 for adding cold water to the water tank 105, and the outlet line 125 includes an outlet opening 135 for withdrawing hot water from the water tank 105 for delivery to a user. The inlet line 120 and the outlet line 125 are in fluid communication with a mixing valve 127. The mixing valve 127 may combine water from both the inlet line 120 and the outlet line 125 in order to output water at a delivery temperature set point. In some embodiments, the mixing valve 127 may include a sensor, such as but not limited to, a water temperature sensor.

The water heater 100 also includes an upper heating element 140, a lower heating element 145, an upper temperature sensor 150, a lower temperature sensor 155, and a control system 180. The upper heating element 140 is attached to an upper portion of the water tank 105 and extends into the water tank 105 to heat the water within the water tank 105. The upper heating element 140 is coupled to the control system 180 to receive an activation signal. When activated, the upper heating element 140 heats the water stored in an upper portion of the water tank 105. In one embodiment, the upper heating element 140 is an electric resistance heating element. In other embodiments, the upper heating element 140 may be a different type of heating element.

The lower heating element 145 is attached to a lower portion of the water tank 105 and extends into the water tank 105 to heat the water stored in the lower portion of the water tank 105. The lower heating element 145 is coupled to the control system 180 to receive an activation signal. When activated, the lower heating element 145 heats the water stored in the lower portion of the water tank 105. In this embodiment, the lower heating element 145 is an electric resistance heating element. In other embodiments, the lower heating element may be a different type of heating element.

Although in the illustrated embodiment, two heating elements 140, 145 are shown, any number of heating elements may be included in the water heater 100. The invention may also be used with other fluid-heating apparatus for heating a conductive fluid, such as an instantaneous water heater or an oil heater, and with other heater element designs and arrangements. In some embodiments, only one of the upper heating element 140 and the lower heating element 145 operates at a time. In other words, the upper heating element 140 and the lower heating element 145 do not operate simultaneously. In such embodiments, the control system 180 prioritizes activation of the upper heating element 140. Because the outlet opening 135 is positioned in the upper portion of the water tank 105, water is withdrawn from the water tank 105 from the upper portion of the water tank 105. Therefore, prioritizing activation of the upper heating element 140 helps ensure that the water withdrawn from the water tank 105 is at the specified setpoint (e.g., a user-defined setpoint). The lower heating element 145 then operates once the water in the upper portion has reached the specified setpoint.

The upper temperature sensor 150 is positioned in the upper portion of the water tank 105 to determine a temperature of the water stored in the upper portion of the water tank 105. Analogously, the lower temperature sensor 155 is positioned in the lower portion of the water tank 105 to determine a temperature of the water in the lower portion of the water tank 105. The upper temperature sensor 150 and the lower temperature sensor 155 may be attached to the water tank 105, and may include, for example, thermistor type sensors. The upper temperature sensor 150 and the lower temperature sensor 155 are coupled to the control system 180 to periodically provide the sensed temperatures to the control system 180. In some embodiments, the water tank 105 may include more temperature sensors to provide a more accurate indication of the temperature of water inside the water tank 105. For example, the water tank 105 may be divided into three or more portions and a temperature sensor may be positioned in each portion.

Figure 2:
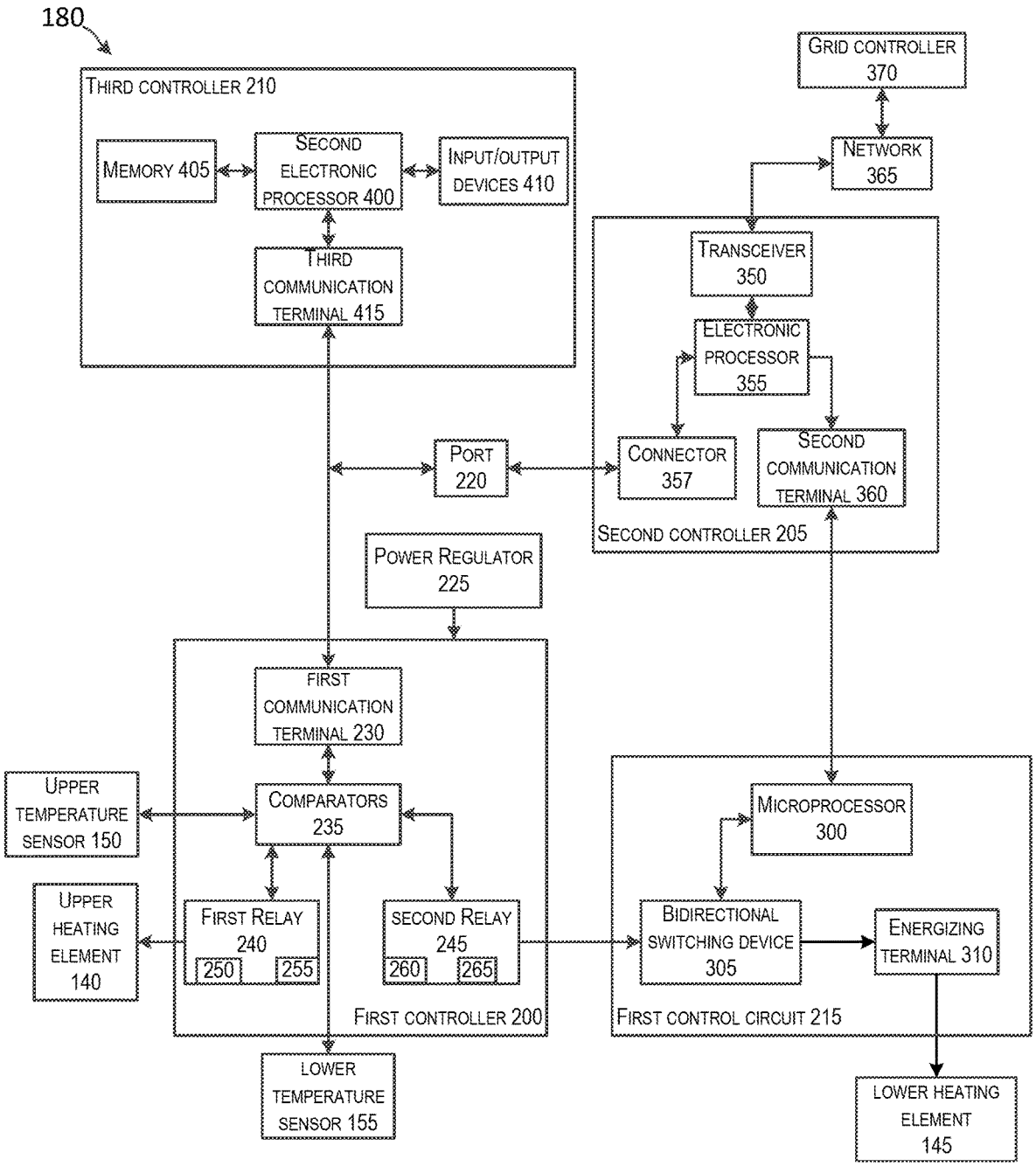
FIG. 2 is a schematic diagram of a control system of the water heater of FIG. 1 according to some embodiments of the invention.

FIG. 2 illustrates a schematic diagram of the control system 180. In the illustrated embodiment, the control system 180 is attached to the water heater 100. In some embodiments, the control system 180, or at least part of the control system 180 may be located remotely from the water heater 100. The control system 180 includes combinations of hardware and software that are operable to, among other things, control the operation of the water heater 100. As shown in FIG. 2, the control system 180 includes a first controller 200, a second controller 205, a third controller 210, a first control circuit 215, and a connection port 220.

The first controller 200 receives power from a power regulator 225. The power regulator 225 receives power from an alternating-current (AC) power source (not shown). In one embodiment, the AC power source provides approximately 120 VAC at a frequency of approximately 50 Hz to approximately 60 Hz. In another embodiment, the AC power source provides approximately 220 VAC at a frequency of approximately 50 Hz to approximately 60 Hz. In other embodiments, the power regulator 225 may provide a lower or higher voltage to the first controller 200. The first controller 200 includes a first communication terminal 230, comparators 235, a first relay 240, and a second relay 245. The first communication terminal 230 includes a cable connector that supplies power and a communication link to the port 220 and the third controller 210. The first controller 200 exchanges data and/or control signals with the port 220 and the third controller 210 through the first communication terminal 230. In some embodiments, the first controller 200 forwards data signals from the upper temperature sensor 150 and the lower temperature sensor 155 to at least the third controller 210.

The comparators 235 are coupled to the upper temperature sensor 150, the lower temperature sensor 155, the first communication terminal 230, the first relay 240, and the second relay 245. The comparators 235 receive the temperature signals from the upper temperature sensor 150 and the lower temperature sensor 155. Based on the received temperature signals, the comparators 235 generate output first control signal transmitted to the first relay 240, and a second control signal transmitted to the second relay 245. The first and second control signals indicate to the first relay 240 and second relay 245, respectively, when to transmit driving power (e.g., power from the AC power source 225).

The first relay 240 is further coupled to the upper heating element 140. The first relay 240 includes a first control terminal 250 and a first power output terminal 255. The first control terminal 250 receives the first control signal from the comparators 235. The first relay 240 then transmits driving power, through the first power output terminal 255, to the upper heating element 140 according to the first control signal. The second relay 245 is further coupled to the first control circuit 215. The second relay 245 includes a second control terminal 260 and a second power output terminal 265. The second control terminal 260 receives the second control signal from the comparators 235. The second relay 245 then transmits driving power, through the second power output terminal 265, to the first control circuit 215 according to the second control signal.

The first control circuit 215 includes a microprocessor 300, a bidirectional switching device 305 (e.g., an electronic switching device), and an energizing terminal 310. The first control circuit 215 is coupled to the first controller 200 through the bidirectional switching device 305, and to the second controller 205 through the microprocessor 300. The first control circuit 215 receives processing power and data and/or control signals from the second controller 205 at the microprocessor 300. In some embodiments, the first control circuit 215 communicates with the second controller 205 through a communication cable that is routed within a protected conduit. The communication cable is packaged and positioned inside or outside a tank jacket. This communication cable provides a dedicated channel (e.g., a serial channel) for communication between the second controller 205 and the first control circuit 215. The first control circuit 215 may also receive driving power from the second power output terminal 265. Based on the control signals from the second controller 205, the microprocessor 300 controls the bidirectional switching device 305.

The bidirectional switching device 305 is coupled to the microprocessor 300, to the second power output terminal 265, and to the energizing terminal 310. The bidirectional switching device 305 switches between a first state and a second state. In the first state (e.g., an enabled state), the bidirectional switching device 305 transfers driving power from the second power output terminal 265 to the energizing terminal 310. In the second state (e.g., a disabled state), the bidirectional switching device 305 interrupts transmission of driving power between the second power output terminal 265 and the energizing terminal 310. The bidirectional switching device 305 receives control signals from the microprocessor 300, and switches between the enabled state and the disabled state based on the control signals. In one embodiment, the bidirectional switching device 305 is an electronic switching device, such as but not limited to, a triac. In other embodiments, the bidirectional switching device 305 may include other switching devices that are capable of transmitting AC power. In some embodiments, the bidirectional switching device is mounted to a heat sink. In such an embodiment, the heat sink may be mounted to the lower portion of the water tank 105. In such an embodiment, the water tank 105 may provide sufficient cooling for the bidirectional switching device 305.

The energizing terminal 310 includes connectors (e.g., conducting terminals) to conduct the power from the second relay 245 and the bidirectional switching device 305 to the lower heating element 145. As illustrated, the energizing terminal 310 is coupled between the bidirectional switching device 305 and the lower heating element 145. The energizing terminal 310 receives driving power from the second power output terminal 265 when the bidirectional switching device 305 is in the enabled state. The energizing terminal 310, when receiving driving power, transmits at least part of the received driving power to the lower heating element 145 to heat the water in the lower portion of the water tank 105.

As shown in FIG. 2, the second controller 205 is coupled to the first controller 200 and to the third controller 210 via the port 220. In one embodiment, the port 220 is positioned near the upper portion, or top, of the water heater 100 and is easily accessible to the user. In some embodiments, the second controller 205 is removably connected, via the port 220, from the first controller 200 and the third controller 210. The second controller 205 includes a transceiver 350, an electronic processor 355, a connector 357, and a second communication terminal 360. The transceiver 350 communicates with a network 365 such as, for example, a WLAN, Wi-Fi network, Internet, and the like. The network 365 receives and/or stores information regarding an electrical grid from a grid controller 370. The electrical grid distributes electrical energy to various consumers. The grid controller 370 monitors the electrical grid. For example but not limited to, the grid controller 370 monitors the current and/or expected demand on the electrical grid. The grid controller 370 provides specific commands and/or regulation signals to the network 365 to help monitor and balance the demand on the electrical grid. The grid controller 370 may provide regulation signals, for example, to control the load from a particular consumer or set of consumers (e.g., in a particular geographical region), operate appliances (e.g., water heater 100) at a particular voltage and/or a particular frequency, and the like. These regulation signals allow the grid controller 370 to have a more precise control over the demand on the electrical grid. The grid controller 230 may also send other commands to the water heater 100 such as, for example, a "Shed Load" signal to decrease the electrical load from the water heater 100. Additionally, or alternatively, the grid controller 230 may provide information to the network 365 regarding, for example, on-peak times, off-peak times, pricing information, and the like.

The transceiver 350 receives regulation signals and information concerning the electrical grid through the network 365, and sends the electrical grid information to the electronic processor 355. In some embodiments, the grid controller 370 is operated by the utility. In other embodiments, the grid controller 370 is operated by a third-party. In such an embodiment, the third-party may be a third-party aggregator. In such an embodiment, the third-party aggregator monitors the grid independently of the utility and sends the load-up signal to the water heater 100 based on such monitoring. In yet other embodiments, the grid controller 370 is a residential grid controller. In such an embodiment, the grid controller 370 may be configured to monitor a home power grid.

The electronic processor 355 is coupled to the transceiver 350, the connector 357, and to the second communication terminal 360. The electronic processor 355 receives the regulation signals, commands, and the electrical grid information (e.g., demand times and/or pricing information) through the transceiver 350. The electronic processor 355 receives processing power (e.g., approximately five-volts) and data signals through the connector 357. For example, the electronic processor 355 receives information regarding the operation of the water heater 100 through the connector 357, which couples the electronic processor 355 to the port 220. The electronic processor 355 may analyze the signals received from the network 365 and generates control signals based on the electrical grid information. The electronic processor 355 then outputs the control signals to the second communication terminal 360.

The second communication terminal 360 is coupled to the electronic processor 355 and to the microprocessor 300 of the first control circuit 215. The second communication terminal 360 transmits processing power (e.g., approximately five-volts) to the first control circuit 215. The second communication terminal 360 also transmits one or more control signals from the second controller 205 to the first control circuit 215. The one or more control signals from the second controller 205 indicate to the first control circuit 215 whether the bidirectional switching device 305 is to be enabled. The control signals from the grid controller 370 may command the lower heating element 140 to switch states (e.g., from activated to deactivated) approximately once per second. Such fast switching rates may result in the second relay 245 becoming inoperable (e.g., due to the mechanical switching employed by the second relay 245). Therefore, adding the bidirectional switching device 305 between the second relay 245 and the lower heating element 145 protects the second relay 245 from performing such fast switching rates, thereby extending the life of the water heater 100. In other words, the bidirectional switching device 305 performs the fast switching rates instead of the second relay 245. The second relay 245 may switch states at lower rates while continuing to optimize electrical energy utilization by implementing appropriate control (e.g., voltage and/or frequency control) from the grid controller 370 on the lower heating element 145.

Although in the illustrated embodiment, the grid controller 370 provides control signals and/or information regarding the electric grid to a single water heater 100, in other embodiments, the grid controller 370 may be connected to several water heaters and may be able to provide control signals to various water heaters and/or other appliances. In some embodiments, the second controller 205 is also connected to more than one water heater 100 and may forward the control signals from the grid controller 370 to more than just a single water heater 100 (e.g., first control circuit 215, first controller 200).

The control system 180 also includes a third controller 210. The third controller 210 is coupled to the first controller 200 and to the second controller 205. The third controller 210 includes a second electronic processor 400, a memory 405, input/output devices 410, and a third communication terminal 415. The third communication terminal 415 exchanges information with the second controller 205 and the first controller 200. In such an embodiment, the third communication terminal 415 also receives processing power (e.g., approximately five-volts) to power the third controller 210.

The memory 405 stores algorithms and/or programs used to control the upper heating element 140, the lower heating element 145, and other components of the water heater 100. The memory 405 may also store historical data, usage patterns, and the like to help control the water heater 100. The second electronic processor 400 is coupled to the third communication terminal 415, the input/output devices 410, and the memory 405. The second electronic processor 400 is configured, for example, to receive the temperature signals from the upper temperature sensor 150 and the lower temperature sensor 155. The second electronic processor 400 accesses those algorithms and programs from the memory 405 to execute such control of the water heater 100. The second electronic processor 400 also exchanges data signals with the input/output devices 410 to modify and/or specify which algorithms and/or programs are to be executed by the second electronic processor 400.

The input/output devices 410 output information to the user regarding the operation of the water heater 100 and also receive user inputs. In some embodiments, the input/output devices 410 may include a user interface for the water heater 100. The input/output devices 410 may include a combination of digital and analog input or output devices required to achieve level of control and monitoring for the water heater 100. For example, the input/output devices 410 may include a touch screen, a speaker, buttons, and the like to receive user input regarding the operation of the water heater 100 (for example, a temperature set point at which water is to be delivered from the water tank 105). The second electronic processor 400 also outputs information to the user in the form of, for example, graphics, alarm sounds, and/or other known output devices. The input/output devices 410 may be used to control and/or monitor the water heater 100. For example, the input/output devices 410 may be operably coupled to the control system 180 to control temperature settings of the water heater 100. For example, using the input/output devices 410, a user may set one or more temperature set points for the water heater 100.

The input/output devices 410 are configured to display conditions or data associated with the water heater 100 in real-time or substantially real-time. For example, but not limited to, the input/output devices 410 may be configured to display measured electrical characteristics of the upper heating element 140 and lower heating element 145, the temperature sensed by temperature sensors 150, 155, etc. The input/output devices 410 may also include a "power on" indicator and an indicator for each heating element 140, 145 to indicate whether the element is active.

The input/output devices 410 may be mounted on the shell of the water heater, remotely from the water heater 100 in the same room (e.g., on a wall), in another room in the building, or even outside of the building. The interface between the control system 180 and the user interface 280 may include a 2-wire bus system, a 4-wire bus system, or a wireless signal. In some embodiments, the input/output devices 410 may also generate alarms regarding the operation of the water heater 100.

In one embodiment, the third controller 210 operates in conjunction with the first controller 200 to operate the water heater 100. In some embodiments, the third controller 210 in combination with the first controller 200 may be included as a single controller. In some embodiments, the first controller 200 and/or the third controller 210 may be coupled to an external device through, for example, a remote network, a transceiver, and the like. In some embodiments, the first control circuit 215 and the second controller 205 are manufactured, sold, and/or provided as a single add-on package. The first control circuit 215 and the second controller 205 are then compatible to connect to the first controller 200 and/or the third controller 210 that may already be positioned at the water heater 100. Therefore, a user may upgrade an existing water heater by adding the add-on package including the first control circuit 215 and the second controller 205. Similarly, manufacturing costs may be reduced by producing the first control circuit 215 and the second controller 205 separately from the first controller 200 and the third controller 210. For example, a manufacturer may continue to build water heaters including the first controller 200 and the third controller 210. Optionally, the manufacturer may add the second controller 205 and the first control circuit 215 to the water heater 100 and sell the water heater 100 as an upgraded version.

Figure 3:
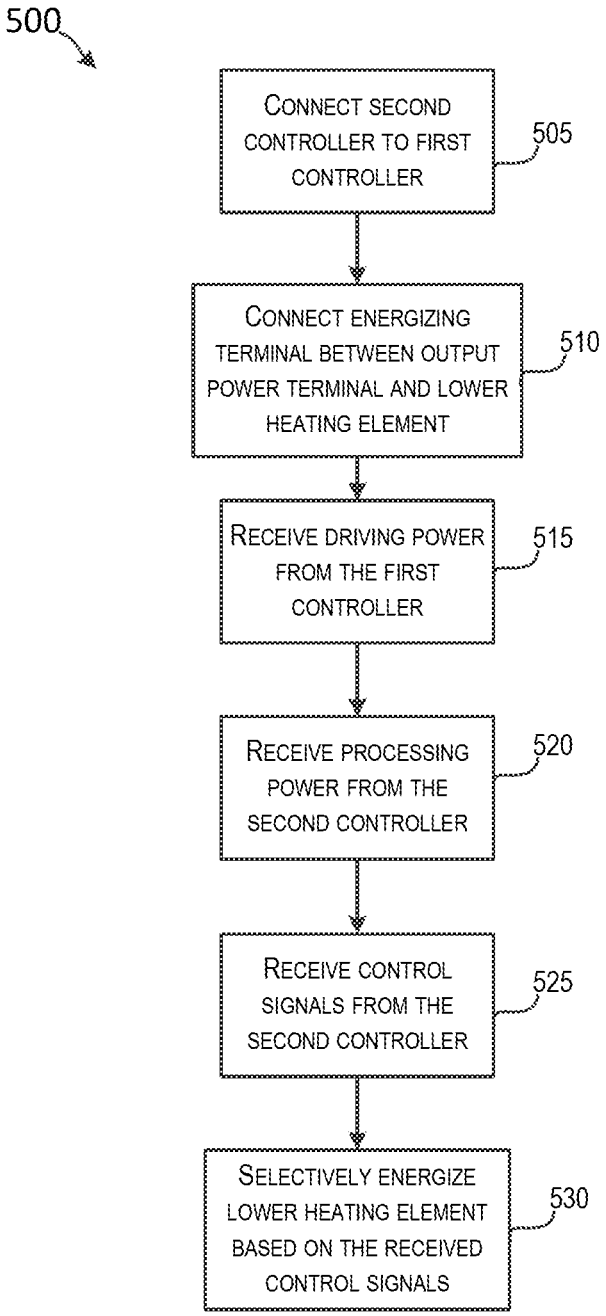
FIG. 3 is a flowchart illustrating a method of operating the water heater of FIG. 1 according to some embodiments of the invention.

FIG. 3 is a flowchart illustrating a process, or method, 500 of operating the water heater 100 according to an embodiment of the invention. It should be understood that the order of the steps disclosed in process 500 could vary. Furthermore, additional steps may be added to the control sequence and not all of the steps may be required. As shown in FIG. 3, initially, the second controller 205 is coupled to the first controller 200 and to an external network 365 (block 505). The energizing terminal 310 is also coupled between the power output terminal 265 and the lower heating element 145 (block 510). The first control circuit 215 receives processing power from the second controller 205 (block 515). The first control circuit 215 also receives driving power from the first controller 200 based on a temperature signal from the lower temperature sensor 155 (block 520). During operation, the first control circuit 215 receives a control signal from the second controller 205 (block 525). As discussed previously, the control signals from the second controller 205 are based on the signals and/or information received by the second controller 205 from the grid controller 370 regarding a current and/or future state of the electrical grid. The microprocessor 300 then proceeds to selectively energize the lower heating element 145 through the energizing terminal 310 based on the control signals received from the second controller 205 (block 530).

Figure 4:
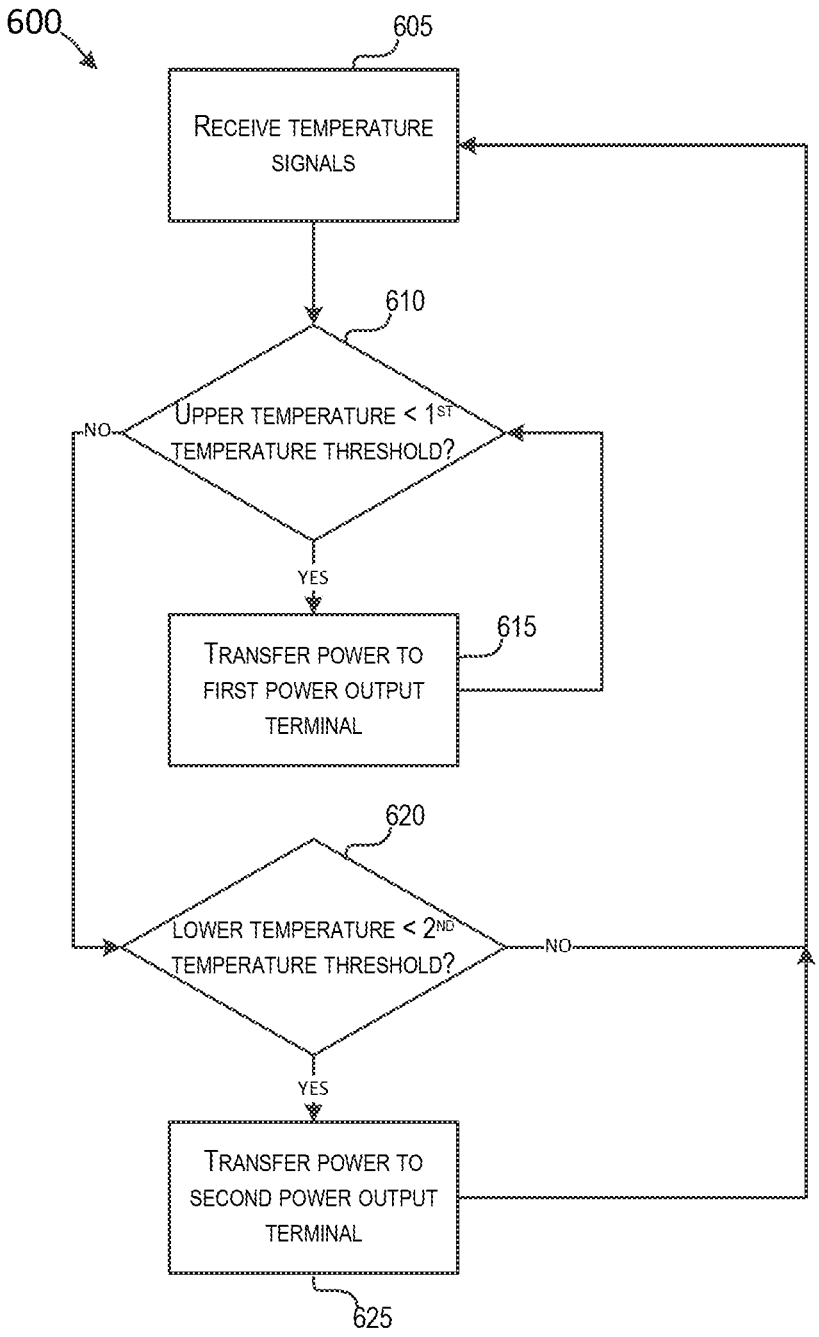
FIG. 4 is a flowchart illustrating a method of outputting driving power to a first control circuit of the control system of FIG. 2 according to some embodiments of the invention.

FIG. 4 is a flowchart illustrating a process, or method, 600 of operating the water heater 100 according to some embodiments of the invention. It should be understood that the order of the steps disclosed in process 600 could vary. Furthermore, additional steps may be added to the control sequence and not all of the steps may be required. In some embodiments, method 600 is implemented by the first controller 200 for outputting driving power through the second power output terminal 265 to the first control circuit 215. As shown in FIG. 4, the first controller 200 first receives temperature signals from the upper temperature sensor 150 and the lower temperature sensor 155 (block 605). The first controller 200 then determines whether the upper temperature signal is below a first temperature threshold (block 610). The temperature threshold may be a user-defined temperature threshold. In other embodiments, the temperature threshold may be a threshold defined by, for example, previous usage patterns analyzed by the third controller 210. When the comparators 235 determine that the upper temperature signal is below the first temperature threshold, the comparators 235 output a control signal to the first relay 240 to activate the first relay 240 (block 615). When the first relay 240 is activated, driving power is provided to the upper heating element 140 through the first power output terminal 255. As discussed above, the comparators 235 give priority to energizing the upper heating element 140 such that the water delivered to the user is at the user-defined threshold. Therefore, the first relay 240 remains activated until the upper temperature signal reaches the first temperature threshold. After ensuring that the upper water temperature is at the first temperature threshold, the comparators 235 proceed to analyze the lower temperature signal against the second temperature threshold (block 620). In step 610, when the comparators 235 determine that the upper temperature signal is greater than or equal to the first temperature threshold, the method 600 proceeds to block 620 and the comparators 235 determine whether the lower temperature signal is below a second temperature threshold (block 620).

In some embodiments, the second temperature threshold is different than the first temperature threshold. In one embodiment, the second temperature threshold is lower than the first temperature threshold. In other embodiments, the second temperature threshold may be the same as the first temperature threshold. When the comparators 235 determine that the lower temperature signal is below the second temperature threshold, the comparators 235 output a control signal to the second relay 245 to activate the second relay 245 (block 625). When the second relay 245 is activated, driving power is provided to the first control circuit 215 through the second power output terminal 265. After activating the second relay 245, the first controller 200 continues to receive temperature signals as described with respect to block 605 to continue to activate and deactivate the first and second relays 240, 245. Similarly, in block 620, when the comparators 235 determine that the lower temperature signal is not less than the second temperature threshold, the comparators 235 continue to receive temperature signals from each of the upper temperature sensor 150 and the lower temperature sensor 155 (block 605). Therefore, as shown in FIG. 4, the second power output terminal 265 only outputs driving power to the first control circuit 215 when the lower temperature signal is below (or equal to) the second temperature threshold.

Figure 5:
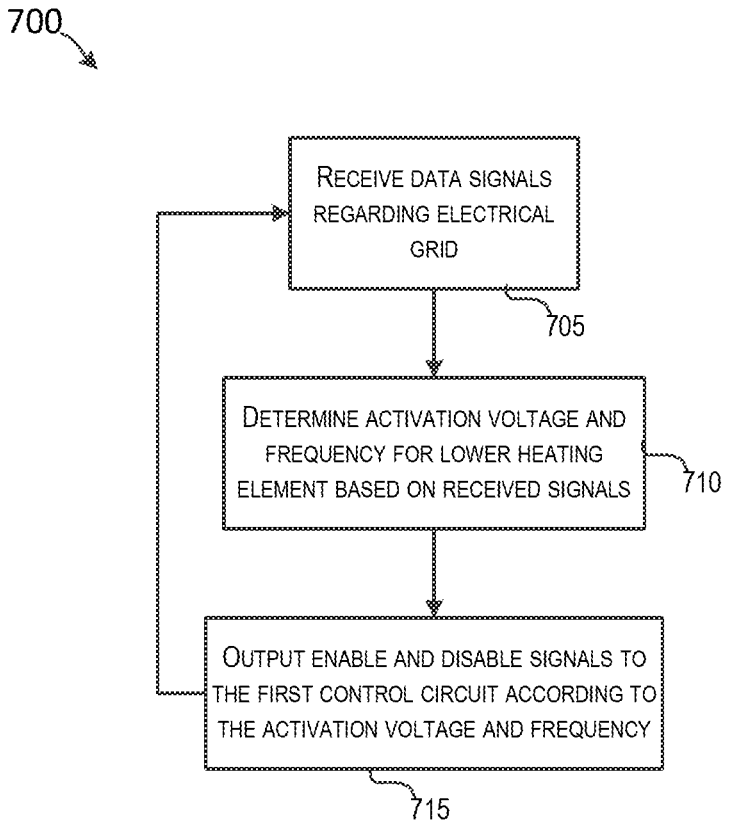
FIG. 5 is a flowchart illustrating a method of outputting control signals to the first control circuit of the control system of FIG. 2 according to some embodiments of the invention.

FIG. 5 is a flowchart illustrating a method, or process, 700 implemented by the second controller 205 to transmit the control signals to the first control circuit 215 according to some embodiments of the invention. It should be understood that the order of the steps disclosed in process 700 could vary. Furthermore, additional steps may be added to the control sequence and not all of the steps may be required. Initially, the second controller 205 receives control and/or data signals regarding the electrical grid through the network 365 (block 705). As discussed above, in some embodiments, the control signals may include commands to enable or disable the lower heating element 145. The data signals may include information regarding a current and/or projected demand for electricity, whether the electrical grid is currently in an off-peak (e.g., low demand) period or a peak (e.g., high demand) period, and/or more specific pricing information for the electrical grid. During off-peak periods, electricity costs are significantly reduced. Therefore, the electronic processor 355 determines, based on the received signals, an activation voltage and frequency for the lower heating element 145 (block 710). For example, in some embodiments, the control signals indicate the specific voltage and/or frequency for the lower heating element 145 while in other embodiments, the electronic processor 355 determines whether the electrical grid is in a peak period to determine the activation voltage and frequency of the lower heating element. The electronic processor 355 then outputs enable and disable signals to the first control circuit according to the determined activation voltage and frequency for the lower heating element 145 (block 715). The enable signal indicates to the first control circuit 215 that the bidirectional switching device 305 is to be enabled (i.e., conducting) such that the lower heating element 145 is activates and the water in the lower portion of the water heater 100 is heated. The disable signal indicates to the first control circuit 215 that the bidirectional switching device 305 is to remain disabled (i.e., non-conducting) such that the lower heating element 145 is not activated. For example, when the electronic processor 355 of the second controller 205 determines that the electrical grid 370 is in a peak period, the electronic processor 355 of the second controller 205 sends a disable signal to the first control circuit 215 through the second communication terminal 360. Preventing activation of the lower heating element 145 during peak periods of the electrical grid 370 reduces operating costs for the water heater 100, while continuing to provide water at the desired temperature to the user. Analogously, heating the water during off-peak periods takes advantage of the lower electricity costs and stores some of the excess electrical energy in heated water for later use. Providing the enable and disable signals at the specified voltage and frequency allows the grid controller 370 to control the amount of electrical energy spent by the water heater 100 more precisely.

Additionally, to maintain control of the lower heating element 145, the second controller 205 (e.g., the electronic processor 355) sends the disable signal to the bidirectional switching device 305 such that the lower temperature signal remains slightly below the second temperature threshold. By maintaining the lower temperature signal slightly below the second temperature threshold, the second relay 245 remains activated, thereby passing driving power to the bidirectional switching device 305. The bidirectional switching device 305 is then controlled by the second controller 205. Otherwise, when the lower temperature signal reaches the second temperature threshold, the second relay 245 is deactivated and the control to the bidirectional switching device 305 is no longer able to control the activation of the lower heating element 145.

Figure 6:
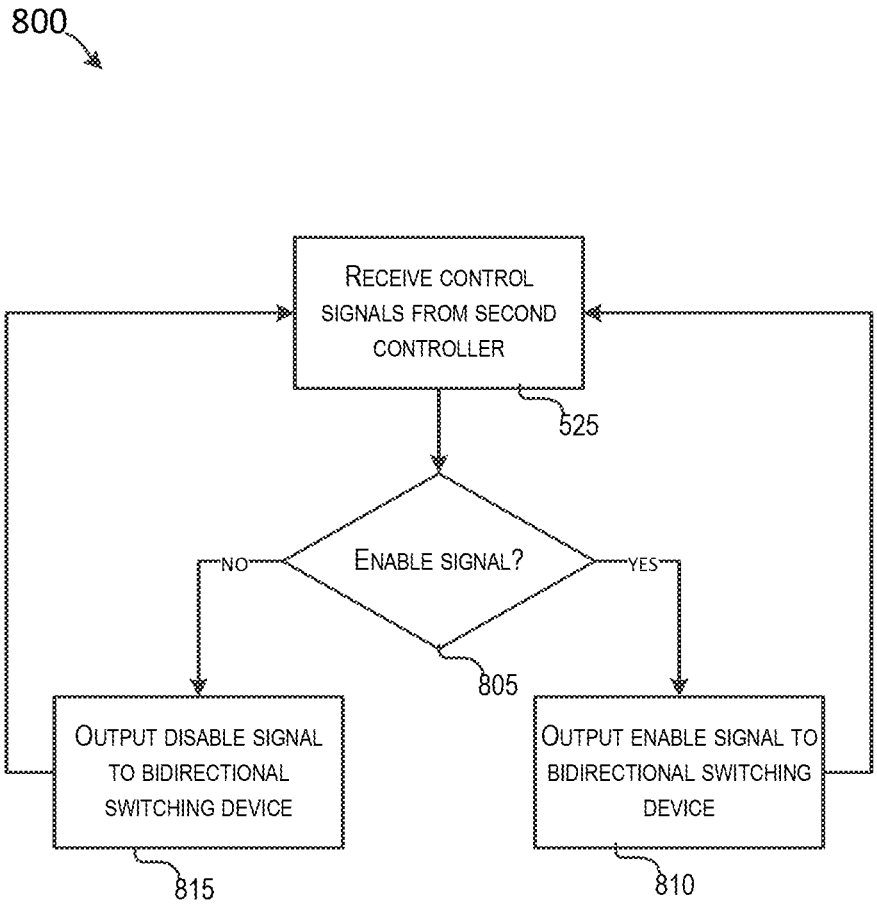
FIG. 6 is a flowchart illustrating a method of selectively energizing a heating element of the water heater of FIG. 1 according to some embodiments of the invention.

FIG. 6 is a flowchart illustrating a method, or process, 800 implemented by the first control circuit 215 to selectively energize the bidirectional switching device 305 according to some embodiments of the invention. It should be understood that the order of the steps disclosed in process 800 could vary. Furthermore, additional steps may be added to the control sequence and not all of the steps may be required. After the first control circuit 215 receives the control signals from the second controller 205 as discussed with reference to block 525 of FIG. 3, the microprocessor 300 determines whether the received control signal includes an enable signal (block 805). When the microprocessor 300 determines that the received signal includes an enable signal, the microprocessor 300 outputs a signal to the bidirectional switching device 305 to enable the bidirectional switching device 305 (i.e., to switch the bidirectional switching device 305 into its conducting state) at block 810. On the other hand, when the microprocessor 300 determines that the received control signal does not include an enable signal (e.g., includes a disable signal), the microprocessor 300 outputs a signal to the bidirectional switching device 305 to disable the bidirectional switching device 305 (e.g., switch to its non-conducting state) at block 815. When the bidirectional switching device 305 is disabled, the bidirectional switching device 305 interrupts driving power to the energizing terminal 310. The energizing terminal 310, however, only receives driving power when the first controller 200 outputs driving power through the second relay 245 (i.e., when the lower temperature signal is below the second temperature threshold) and the second controller 205 sends an enable signal to the first control circuit (e.g., when the electrical grid is not during a peak period).

Figure 7:
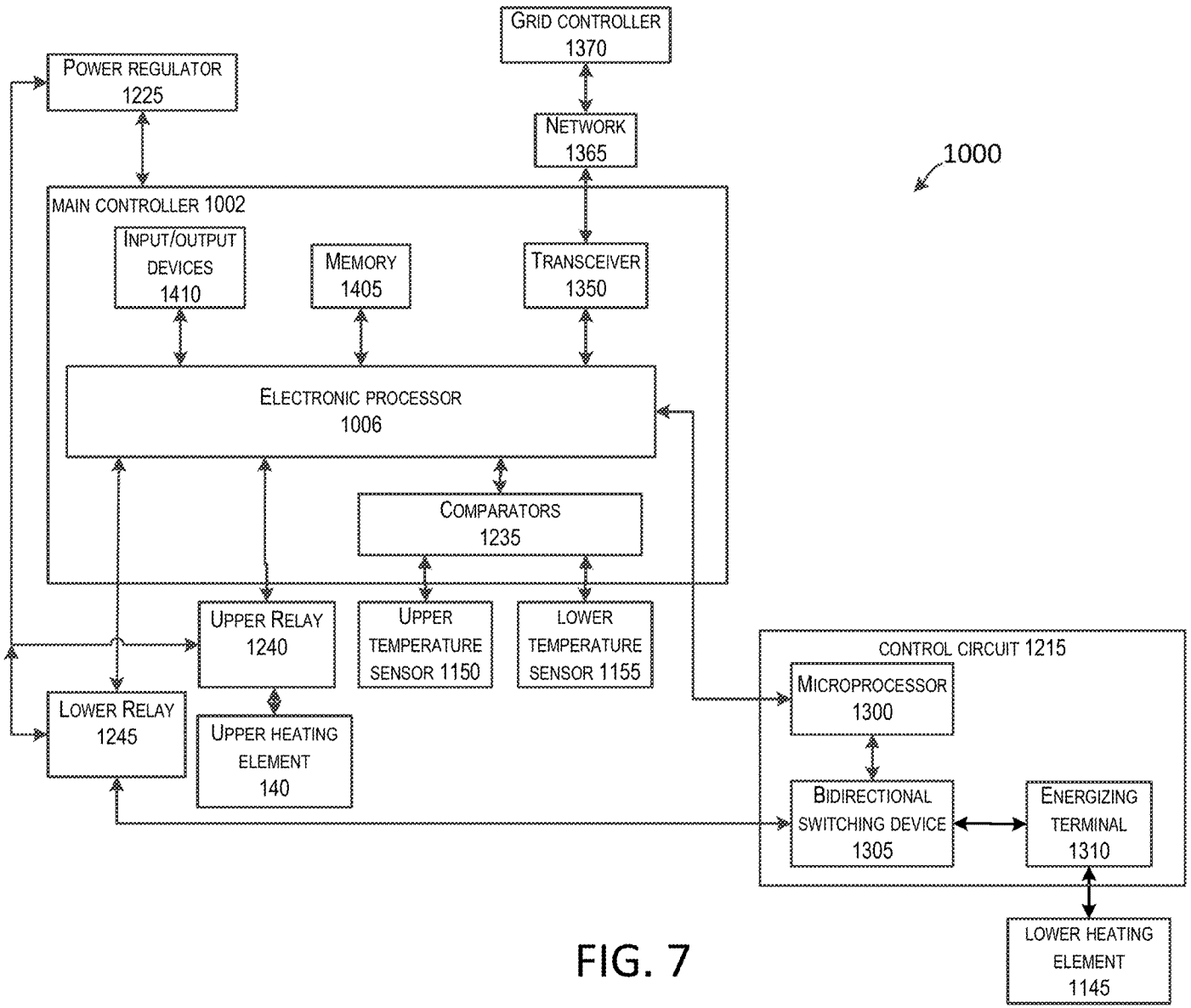
FIG. 7 is a schematic diagram of another embodiment of a control system of the water heater of FIG. 1.

FIG. 7 illustrates another embodiment of a control system 1000 of water heater 100. The control system 1000 may include similar components as the control system 180 shown in FIG. 2, and like parts have been given like reference numbers, plus 1000. As shown in FIG. 7, the control system 1000 includes a main controller 1002, a first control circuit 1215, an upper temperature sensor 1150, an lower temperature sensor 1155, an upper relay 1240, and a lower relay 1245. The control system 1000 receives power from the power regulator 1225, which operates in a similar fashion as power regular 225 of FIG. 2.

In some embodiments, the main controller 1002 combines the functionality of the first controller 1200, the second controller 1205, and the third controller 1210. The control system 1000 is configured to perform those operations described with respect to the first controller 1200, the second controller 1205, and the third controller 1210. As shown in FIG. 7, the main controller 1002 includes an electronic processor 1006 that is communicatively and/or electrically coupled to a control circuit 1215, a set of comparators 1235, a transceiver 1350, a memory 1405, and input/output devices 1405. Additionally, in the illustrated embodiment, the electronic processor 1006 is coupled to the upper relay 1240 and the lower relay 1245. The set of comparators 1235 operate similar to comparators 235 discussed above in relation to FIG. 2. As shown in FIG. 7, the comparators 1235 receive signals from the upper temperature sensor 1150 and the lower temperature sensor 1155. The electronic processor 1006 then determines, based on the output signals from the comparators 1235 whether the lower heating element 1145 and/or the upper heating element 1140 are to be activated. In some embodiments, the electronic processor 1006 may receive the temperature signals directly from the temperature sensors 1150, 1155 and makes similar determinations as the set of comparators 1235.

The electronic processor 1006 sends activation signals to the upper relay 1240 and the lower relay 1245 to activate the upper heating element 1140 and the lower heating element 1145, as determined based on the signals from the comparators 1235. The upper relay 1240 and the lower relay 1245 each include a power output terminal and a control terminal, which may sometimes be referred to as the "power output terminal of the controller." The electronic processor 1006 accesses the memory 1405 to retrieve one or more control algorithms, threshold values, and the like. As shown in FIG. 7, the electronic processor 1006 is also coupled to the input/output devices 1410 to receive user inputs and generate perceivable output for the user (for example, indicator lights, sounds, vibrations, textual and numeric displays, and the like). Additionally, the electronic processor 1006 communicates with an external network 1365 regarding electrical grid information. The external network 1365 operates similar to the network 365 of FIG. 2 and communicates with a grid controller 1370 to receive information regarding the electrical grid providing power to the water heater 100.

In the illustrated embodiment, control circuit 1215 includes similar components as the first control circuit 215 of FIG. 2. In the illustrated embodiment, the control circuit 1215 of FIG. 7 includes a microprocessor 1300, a bidirectional switching device 1305, and an energizing terminal 1310, which operate similar to the components of the first control circuit 215 of FIG. 2. Therefore, the operation of the control circuit 1215 is not described in detail below. The electronic processor 1006 communicates activation signals to the control circuit 1215 for the bidirectional switching device 1305, similar to the activation signals sent from the second controller 210 of FIG. 2. The bidirectional switching device 1305 is coupled to the lower relay 1245 such that the bidirectional switching device 1305 only receives driving power when the lower relay 1245 is activated from the electronic processor 1006. Additionally, the control system 1000 is configured to perform the processes described with respect to FIGS. 3-6. While performing these processes, the electronic processor 1006 may be configured to replace the functionality previously assigned to the first controller 205, the second controller 210, the third controller 1215, and components thereof. The remaining elements of the control system 1000 operate similar to the corresponding components of FIG. 2.

By connecting the first control circuit 215 between a controller (for example controllers 200, 205, 210, 1002) and the lower heating element 145, the control systems 180, 1000 provide control of the lower heating element 145 based on temperature and based on the state (e.g., pricing and/or regulation) of the electrical grid. Additionally, by providing removable connections of the first control circuit 215 and the second controller 205, as described with respect to FIG. 2, the water heater 100 leverages the capabilities of water heater control through the first controller 200 and the third controller 210 (for example, for base models) with the expandability of the first control circuit 215 and the second controller 205 (for example, for premium and/or sustainable models). The control systems 180, 1000 also provide a back-up system for the control of the lower heating element 145. For example, if the bidirectional switching device 305 fails as a short circuit, a controller (for example controllers 200, 205, 210, 1002) continues to have control over the activation of the lower heating element 145 based on temperature signals. In additions, the bidirectional switching device 305 may cycle on and off before or after the second relay 245, which reduces arcing and cycling stresses of the second relay 245. Therefore, the life of the second relay 245 is increased as well as its frequency of operation.

Various features and advantages of the invention are set forth in the following claims.

What is claimed is:

1. An electric water heater comprising:

an electric heating element;

a switching device capable of operating in an enabled state and a disabled state, the switching device being arranged electrically in series with the electric heating element; and a relay capable of operating in an activated state and a deactivated state, the relay being arranged electrically in series with the switching device and providing electrical power to the switching device when operating in the activated state, wherein the switching device is controlled to operate in one of the enabled state and the disabled state independently of the relay being controlled to operate in one of the activated state and the deactivated state, and wherein the electric heating element receives electrical power only when the relay is operating in the activated state and the switching device is operating in the enabled state.

2. The electric water heater of claim 1, wherein the switching device is a triac.

3. The electric water heater of claim 1, further comprising a temperature sensor, wherein the relay is controlled to operate in the activated state at least in part based on a signal from the temperature sensor.

4. The electric water heater of claim 1, further comprising:

a microprocessor configured to operate the switching device; and a controller in communication with an electrical grid controller, the controller being configured to provide signals to the microprocessor in order to switch the switching device between operating in the enabled state and operating in the disabled state based on commands received by the controller from the electrical grid controller.

5. The electric water heater of claim 1, wherein the electric heating element is a first electric heating element, further comprising:

a tank having an inner volume to hold water; and a second electric heating element, wherein the first and second electric heating elements extend into the inner volume of the tank to heat water contained therein, the first electric heating element being arranged at a lower portion of the tank and the second electric heating element being arranged at an upper portion of the tank.

6. The electric water heater of claim 5, further comprising:

a lower temperature sensor arranged at the lower portion of the tank;

an upper temperature sensor arranged at the upper portion of the tank; and a controller coupled to the upper and lower temperature sensors to receive temperature signals therefrom, the controller being configured to:

compare a temperature signal received from the upper temperature sensor to a first temperature threshold;

compare a temperature signal received from the lower temperature sensor to a second temperature threshold; and upon determining that the temperature signal received from the upper temperature sensor is not below the first temperature threshold and that the temperature signal received from the lower temperature sensor is below the second temperature threshold, operating the relay in the activated state.

7. The electric water heater of claim 6, wherein the controller is a first controller, further comprising:

a microprocessor configured to operate the switching device; and a second controller in communication with an electrical grid controller, the second controller being configured to provide signals to the microprocessor in order to switch the switching device between operating in the enabled state and operating in the disabled state based on commands received by the second controller from the electrical grid controller.

8. The electric water heater of claim 7, wherein the second controller is configured to provide signals to the microprocessor in order to switch the switching device between operating in the enabled state and operating in the disabled state at a rate of approximately once per second.

9. A water heating system comprising:

a tank containing a volume of water;

an electric heating element configured to heat water within the tank;

a communications port;

a first controller coupled to the communications port and to an alternating-current (AC) power source, the first controller including a relay, the relay having a power output terminal;

a second controller coupled to the communications port and in communication with a network; and a control circuit having a switching device, a microprocessor coupled to the switching device, and an energizing terminal coupled to the switching device, wherein the switching device is coupled to the relay to receive AC power from the power source when the relay is in an activated state, the microprocessor is coupled to the second controller to receive control signals therefrom, and the energizing terminal is coupled to the heating element to deliver AC power received from the relay thereto when the switching device is in an enabled state.

10. The water heating system of claim 9, further comprising a communication cable extending between the second controller and the control circuit in order to communicatively couple the microprocessor to the second controller.

11. The water heating system of claim 10, wherein the communication cable provides both control signals and processing power from the second controller to the control circuit.

12. The water heating system of claim 9, further comprising a temperature sensor coupled to the tank to sense the temperature of water at a particular portion of the tank, the temperature sensor being coupled to the first controller to deliver signals from the temperature sensor thereto.

13. The water heating system of claim 12, wherein the first controller is configured to switch the relay between an activated state and a deactivated state at least in part in response to the signals delivered by the temperature sensor.

14. The water heating system of claim 9, wherein the second controller is configured to receive commands from the network and to send corresponding control signals to the control circuit, and wherein the microprocessor is configured to switch the switching device between an enabled state and a disabled state in response to the control signals.

15. The water heating system of claim 14, wherein at least one of the commands and the control signals includes frequency information.

16. The water heating system of claim 9, wherein the second controller is removably connected to the communications port.

* * * * *